US011096456B2

(12) United States Patent
Hinds et al.

(10) Patent No.: US 11,096,456 B2
(45) Date of Patent: Aug. 24, 2021

(54) WRIST STRAP

(71) Applicant: ACCESSO TECHNOLOGY GROUP PLC, Twyford (GB)

(72) Inventors: Sebastian Hinds, Salisbury (GB); Carl Clement, Norwich (GB); Daniel Coveney, Cambridge (GB); Hallam Collings, Impington (GB)

(73) Assignee: ACCESSO TECHNOLOGY GROUP PLC, Twyford (GB)

( * ) Notice: Subject to any disclaimer, the term of this patent is extended or adjusted under 35 U.S.C. 154(b) by 0 days.

(21) Appl. No.: 16/637,750

(22) PCT Filed: Jul. 11, 2018

(86) PCT No.: PCT/GB2018/051974
§ 371 (c)(1),
(2) Date: Feb. 8, 2020

(87) PCT Pub. No.: WO2019/030466
PCT Pub. Date: Feb. 14, 2019

(65) Prior Publication Data

US 2020/0205530 A1 Jul. 2, 2020

(30) Foreign Application Priority Data

Aug. 10, 2017 (GB) ..... 1712804

(51) Int. Cl.
*A44C 5/20* (2006.01)
*A44C 5/16* (2006.01)
*A44C 5/00* (2006.01)

(52) U.S. Cl.
CPC ..... *A44C 5/16* (2013.01); *A44C 5/0007* (2013.01)

(58) Field of Classification Search
CPC ... A44C 5/2071; A44C 5/22; Y10T 24/45063; Y10T 24/4782; G04B 37/18; G04B 37/14
USPC ..... 368/282
See application file for complete search history.

(56) References Cited

U.S. PATENT DOCUMENTS

| | | | |
|---|---|---|---|
| 1,851,733 | A | 3/1932 | Lewis |
| 2,466,741 | A | 4/1949 | Roehrl |
| 2015/0342308 | A1 | 12/2015 | Wilson |

FOREIGN PATENT DOCUMENTS

| | | |
|---|---|---|
| CN | 2754416 | 2/2006 |
| DE | 202007012650 | 1/2008 |
| EP | 2859840 | 4/2015 |
| EP | 2859840 A1 | 4/2015 |

(Continued)

OTHER PUBLICATIONS

ISR for PCT/GB2018/051974 (Feb. 5, 2019).

(Continued)

*Primary Examiner* — Jack W Lavinder

(57) ABSTRACT

A wrist strap which comprises a first portion defining a first end of the wrist strap, and a second portion defining a second end of the wrist strap. The wrist strap further comprises an aperture located in the first portion, through which the second end of the strap is passable to define an overlapping region in which a part of the first portion and the second portion of the wrist strap overlap. A first L-shaped peg is located in one portion of the first and second portions, and a first hole in the strap located in the other portion of the first and second portions. A second L-shaped peg is located in the other portion of the first and second portions, and a second hole in the strap located in the one portion.

12 Claims, 4 Drawing Sheets

(56) References Cited

FOREIGN PATENT DOCUMENTS

| | | |
|---|---|---|
| GB | 2055550 | 3/1981 |
| WO | 2017/037238 | 3/2017 |

OTHER PUBLICATIONS

Search Report for GB1712804.2 for claims 1-2 (dated Feb. 7, 2018).
Search Report for GB1712804.2 for claims 3-5 (dated Feb. 7, 2018).
UKIPO Examination Report for Application No. GB1712804.2 (dated Jul. 8, 2021).

WRIST STRAP

BACKGROUND

The present invention relates to a wrist strap, in particular a wrist strap which is secured to a user's wrist via the use of a peg which fits in a corresponding hole located on the wrist strap.

An example of such a wrist strap is that disclosed in WO 2017/037238.

One disadvantage with the wrist straps disclosed in WO 2017/037238 is that they are unsuitable for use in applications, such as in amusement parks, where the strap is liable to get caught on an object whilst the strap is on a user's wrist. In such situations, the wrist strap remains secured around the user's wrist, risking injury to the user.

Another disadvantage with such wrist straps is that it can be difficult to line up all of the pegs from the strap, at any given time, with the corresponding holes located on the strap.

The present invention aims to resolve the above-identified problems associated with existing wrist straps.

SUMMARY OF THE INVENTION

According to a first aspect of the present invention, there is provided a wrist strap comprising a first portion defining a first end of the wrist strap, and a second portion defining a second end of the wrist strap, the wrist strap further comprising:

- an aperture located in the first portion, through which the second end of the strap is passable to define an overlapping region in which a part of the first portion and the second portion of the wrist strap overlap;
- a first L-shaped peg located in one portion of the first and second portions, and a first hole in the strap located in the other portion of the first and second portions;
- wherein the first L-shaped peg and the first hole are located in the overlapping region once the second end of the strap is passed through the aperture, such that the first L-shaped peg is engageable with the first hole;
- wherein the first L-shaped peg is shaped such that when engaged in the first hole, the end of the first L-shaped peg extends in a direction away from the end of the strap located in the other portion.

By virtue of the L-shaped peg extending in use in a direction away from the end of the strap located in the other portion, in the event of the strap being caught on an object, and a predetermined pulling force thus being exerted on the wrist strap, the L-shaped peg will slide out of the hole in which it is engaged, thus allowing the two portions of the wrist strap to separate from each other.

The wrist strap may further comprise:

- a second L-shaped peg located in the other portion of the first and second portions, and a second hole in the strap located in the one portion;
- wherein the second L-shaped peg and the second hole are located in the overlapping region once the second end of the strap is passed through the aperture, such that the second L-shaped peg is engageable with the second hole;
- wherein the second L-shaped peg is shaped such that when engaged in the second hole, the end of the second L-shaped peg extends in a direction away from the end of the strap located in the one portion.

With the provision of the second L-shaped peg, this allows the wrist strap to be better secured to a user's wrist, whilst at the same time still allowing the two portions of the wrist strap to separate from each other in the event of it being caught on an object.

According to a second aspect of the present invention, there is provided a wrist strap comprising a first portion defining a first end of the wrist strap, and a second portion defining a second end of the wrist strap, the wrist strap further comprising:

- an aperture located in the first portion, through which the second end of the strap is passable to define an overlapping region in which a part of the first portion and the second portion of the wrist strap overlap;
- a first peg located in the first portion, and a first plurality of holes in the second portion;
- a second peg located in the second portion, and a second plurality of holes located in the first portion;
- wherein once the second end of the strap is passed through the aperture, the first peg and a hole from the first plurality of holes are located in the overlapping region, such that the first peg is engageable with the hole from the first plurality of holes;
- wherein once the second end of the strap is passed through the aperture, the second peg and a hole from the second plurality of holes are located in the overlapping region such that the second peg is engageable with the hole from the second plurality of holes;
- wherein the spacing between the holes in the first plurality of holes is different than the spacing between the holes in the second plurality of holes.

By virtue of the spacing between the holes in the first plurality of holes being different than the spacing between the holes in the second plurality of holes, this allows each plurality of holes to better align and engage with its associated peg when the wrist strap is in use on a user's wrist.

Depending on how the second end is passed through the aperture, the spacing between the holes in the first plurality of holes may be greater than, or less than, the spacing between the holes in the second plurality of holes.

In this wrist strap, the first peg may be L-shaped, such that when engaged in a hole from the first plurality of holes, the end of the first L-shaped peg extends in a direction away from the second end of the strap.

The second peg may be L-shaped, such that when engaged in a hole from the second plurality of holes, the end of the second L-shaped peg extends in a direction away from the first end of the strap.

With the provision of such L-shaped pegs, this allows the two portions of the wrist strap to separate from each other in the event of the wrist strap being caught on an object.

DETAILED DESCRIPTION

Figure 1A:
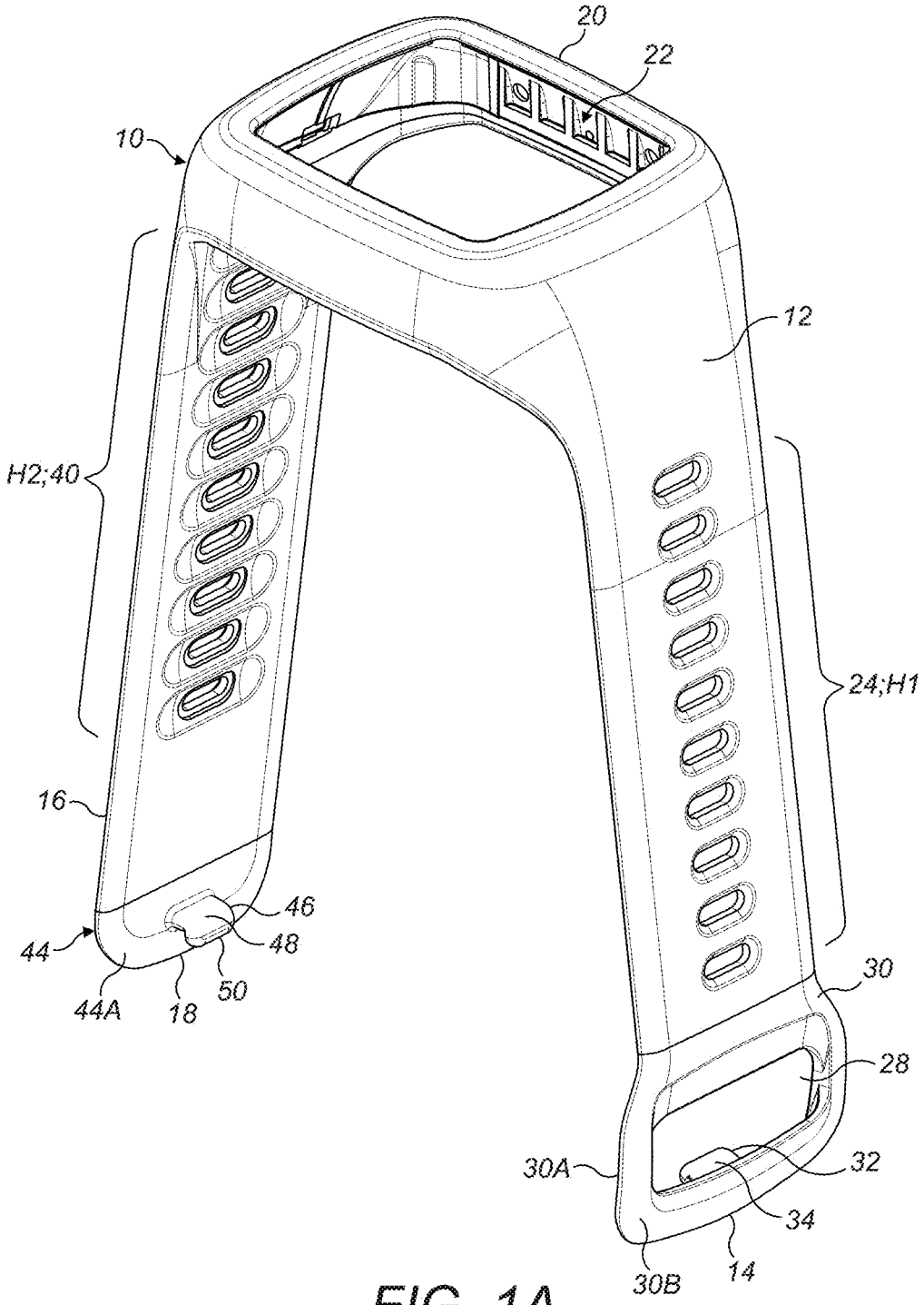
FIG. 1A shows a perspective view of a wrist strap.
Figure 1D:
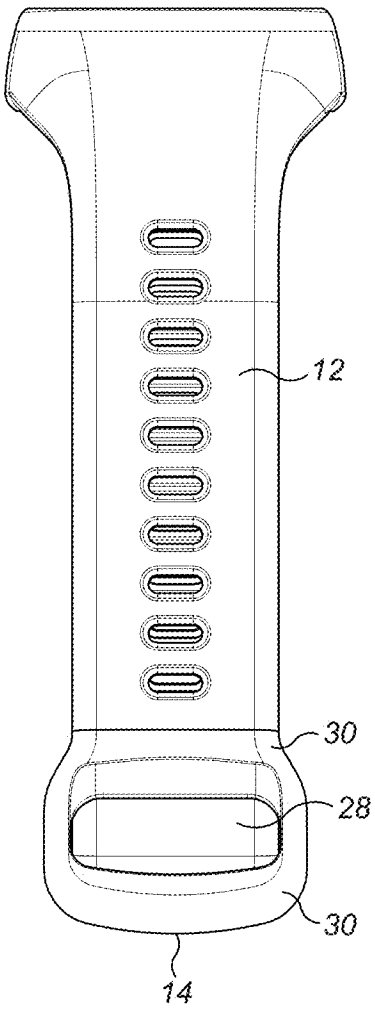
FIG. 1D shows a rear view of the wrist strap from FIG. 1A.
Figure 1C:
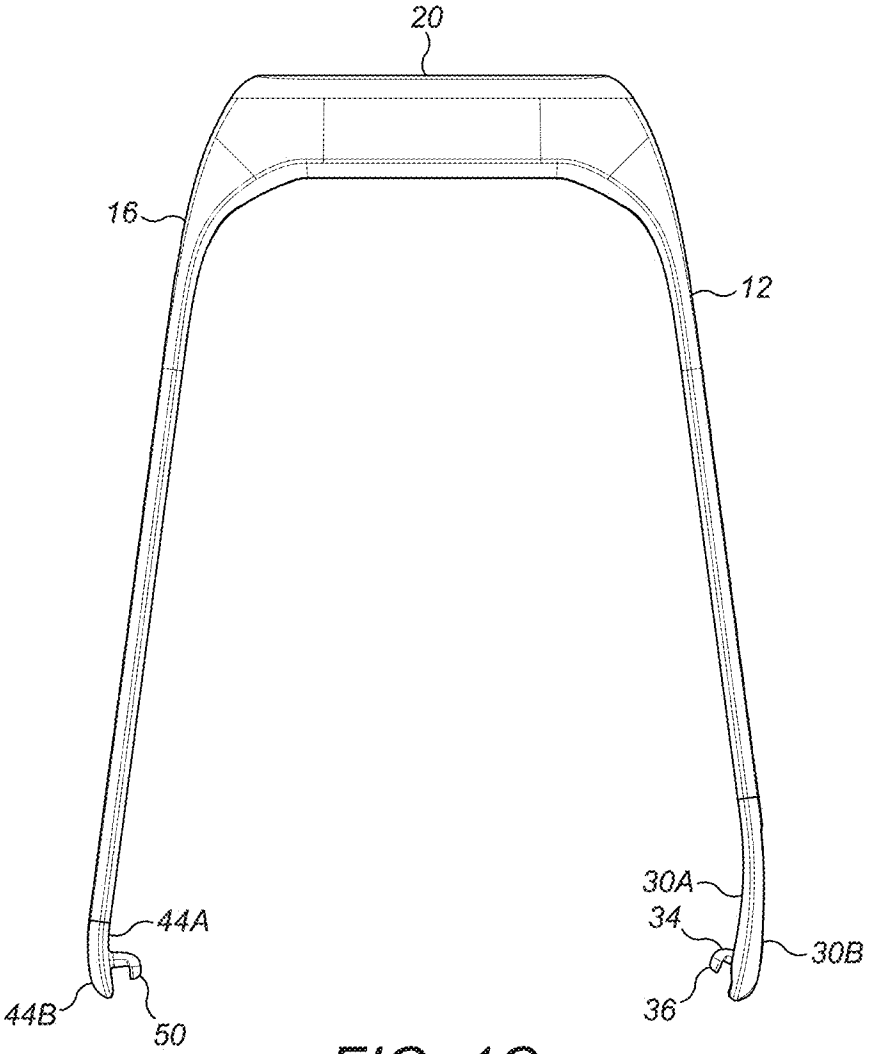
FIG. 1C shows a side view of the wrist strap from FIG. 1A.
Figure 1B:
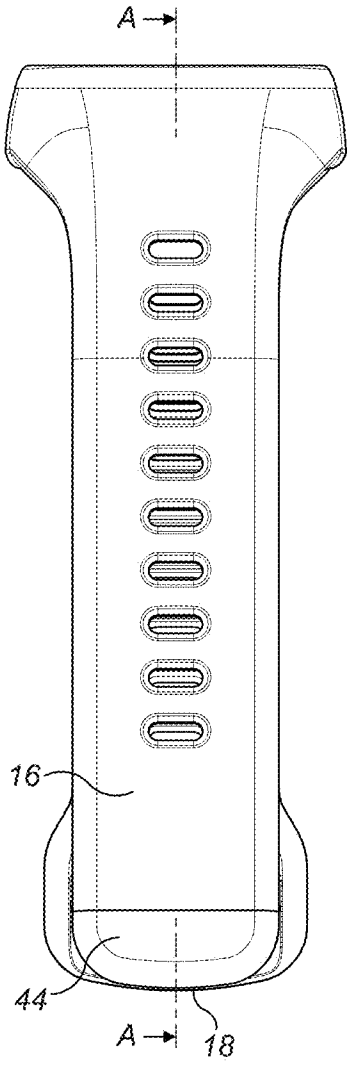
FIG. 1B shows a front view of the wrist strap from FIG. 1A.

With reference to the Figures, there is shown a wrist strap 10 for attaching around a user's wrist. The wrist strap 10 comprises a first portion 12 defining a first end 14 of the strap, and a second portion 16 defining a second end 18 of the strap. The middle 20 of the strap preferably defines a space 22 for receiving an electronic device or a watch face.

The first and second portions 12;16 of the wrist strap 10 may be a continuous piece of material as shown in the Figures, or may be separated into smaller pieces, such as two separate pieces of material which connect either side of the electronic device/watch face positioned at the middle 20 of the wrist strap 10.

Figure 2:
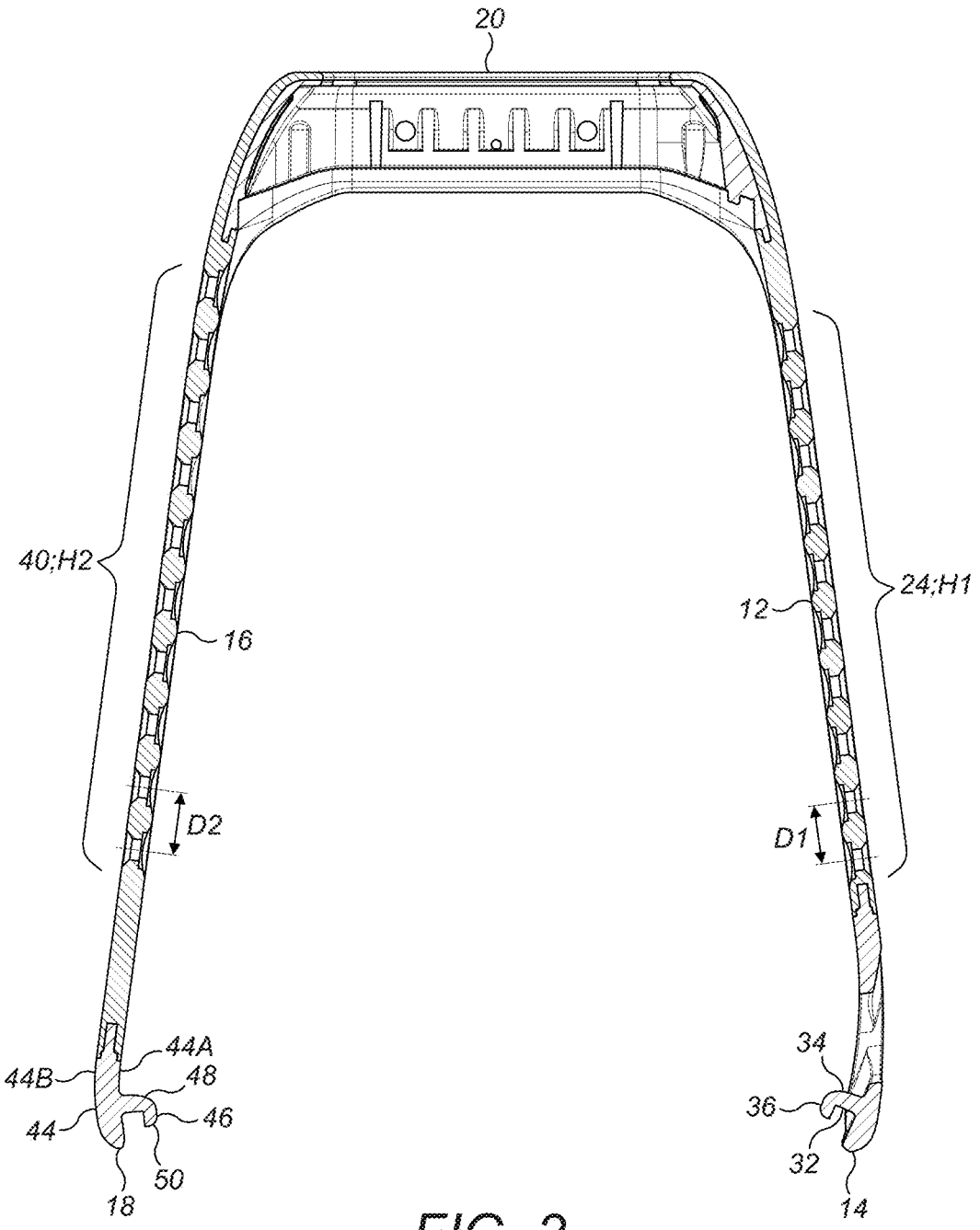
FIG. 2 shows a cross-section view of the wrist strap from FIGS. 1A-1D when taken about section A-A as shown in FIG. 1B.

Distributed along the length of the first portion 12 of the wrist strap 10 is a plurality of holes 24, which are regularly spaced apart from each other. The spacing between the holes, measured between the centres of two neighbouring holes, is defined as a primary spacing D1 (as shown in FIG. 2). In one particular embodiment, the primary spacing may be 6 mm.

The first portion 12 of the wrist strap 10 also comprises an aperture 28, which is proximal the first end 14, through which the second portion 16 of the wrist strap 10 is passable as will be described. The aperture 28 is located in a first rigid member 30 which is associated with the first portion 12.

As shown in FIG. 1A, the first rigid member 30 defines an inside surface 30A, which is operable to face towards the user's wrist in use of the wrist strap 10, and a corresponding outside surface 30B which is operable to face away from the user's wrist.

Associated with the first portion 12 is an L-shaped peg 32. As shown in the Figures, the L-shaped peg 32 comprises a body 34 which extends substantially perpendicularly from the inside surface 30A of the first rigid member 30; and comprises an arm 36 which extends from the body 34, in a single direction, towards the first end 14.

Distributed along the length of the second portion 16 of the wrist strap 10 is a plurality of holes 40, which are regularly spaced apart from each other. The spacing between the holes, measured between the centres of two neighbouring holes, defines a secondary spacing D2 (as shown in FIG. 2), which is ideally greater than then primary spacing D1 from the plurality of holes 24 in the first portion 12. In one particular embodiment, the secondary spacing D2 may be 6.5 mm.

Proximal the second end 18 is a second rigid member 44, associated with the second portion 16, which defines an inside surface 44A operable to face in a direction towards the user's wrist in use of the wrist strap 10, and a corresponding outside surface 44B which is configured to face away from the user's wrist.

Associated with the second portion 16 is an L-shaped peg 46. The L-shaped peg 46 comprises a body 48 which extends substantially perpendicularly from the inside surface 44A of the first rigid member 44; and comprises an arm 50 which extends from the body 48, in a single direction, towards the second end 18.

Operation of the wrist strap 10 is best described with reference to FIG. 3. To secure the wrist strap 10 around a user's wrist, the second end 18 of the strap is passed through the aperture 28 on the first portion 12, such that the second L-shaped peg 46 from the second portion 16 is engageable with a hole H1 from the plurality of holes 24 in the first portion 12 of the strap 10.

Figure 3:
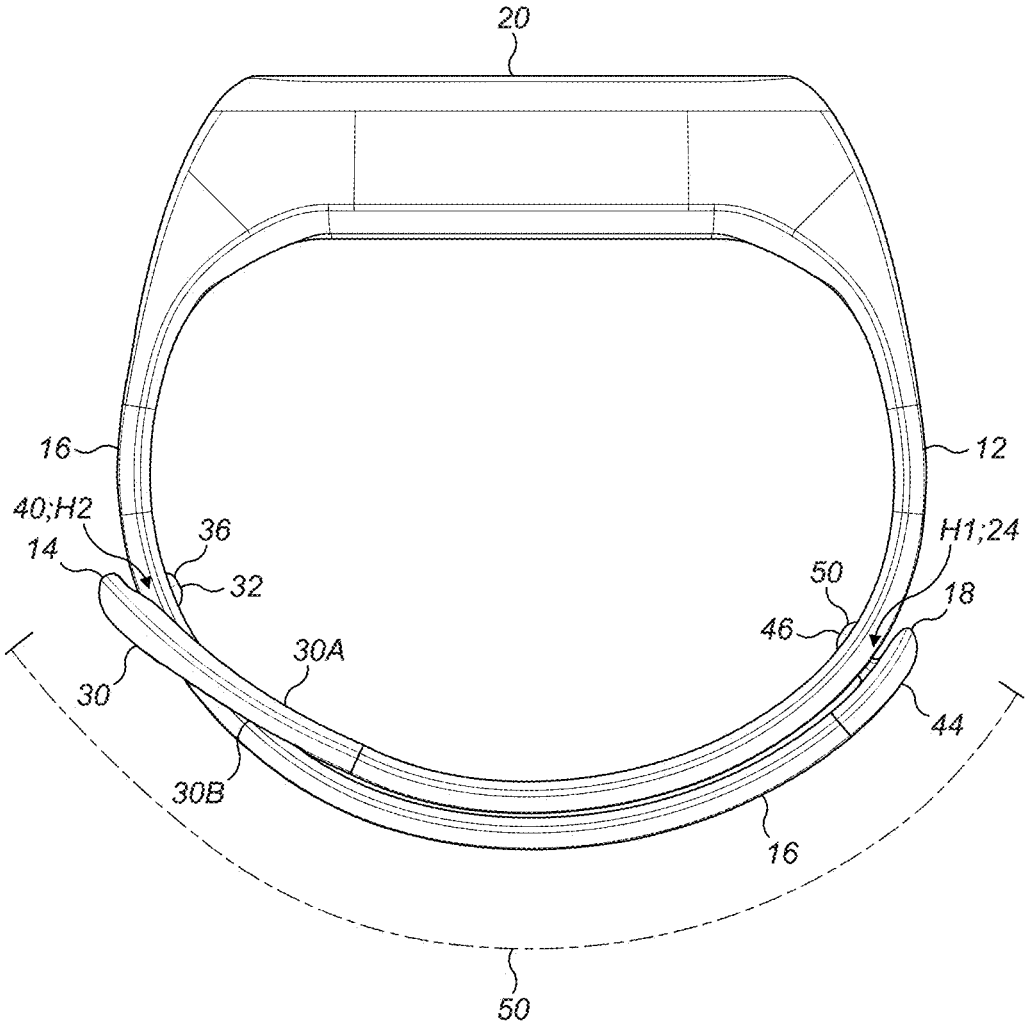
FIG. 3 shows a schematic representation of the wrist strap from FIGS. 1A-1D when in use.

As shown in FIG. 3, the second end 18 of the wrist strap 10 is specifically passed from the inside surface 30A of the first rigid member 30, through the aperture 28, and out past the outside surface 30B of the first rigid member 30. Once passed through the aperture 28, the second portion 16 of the wrist strap extends around the outside of the first portion 12 of the wrist strap, such that the second L-shaped peg 46 is engageable in a hole H1 from the plurality of holes 24 in the first portion 12 by being inserted from the outside face to the inside face of the hole H1.

Once the second L-shaped peg 46 from the second portion 16 of the wrist strap has been engaged in the hole H1 from the first portion 12 of the wrist strap, the first L-shaped peg 32 on the first portion 12 of the wrist strap is engaged with a hole H2 from the plurality of holes 40 in the second portion 16 of the strap 10. As noted in FIG. 3, the first L-shaped peg 32 engages the hole H2 by being inserted from the outside face to the inside face of the hole H2.

Following the engagement of the two L-shaped pegs 32;46 in their respective holes H2;H1, a part of the first portion 12 and the second portion 16 of the wrist strap 10 overlap to create an overlapping region 50 in the wrist strap 10, wherein the two L-shaped pegs 32;46 and their respective holes H2;H1 are located in the overlapping region 50.

When the two L-shaped pegs 32;46 are engaged in their respective holes H2;H1, the end/arm 36 of the first L-shaped peg 32 extends in a sole direction away from the second end 18 of the wrist strap, and the end/arm 50 of the second L-shaped peg 46 extends in a sole direction away from the first end 14 of the wrist strap. In this way, in the event of the wrist strap being caught on an object, and a large pulling force being exerted on the wrist strap, the L-shaped pegs 32;46 will slide out of the holes H2;H1 in which they are engaged, thus allowing the two portions 12;16 of the wrist strap 10 to separate from each other.

With reference to FIG. 3, it can be seen that once the second portion 16 has passed through the aperture 28, the second portion 16 must travel a larger distance than the first portion 12 for a given angular movement. This is because the second portion 16 in this region is located on top of the first portion 12, such that there is a greater radial distance in this region between the second portion 16 and the user wrist, than the first portion 12 and the user's wrist.

To account for this difference in radial distance, and the fact that the second portion 16 must travel a larger distance than the first portion 12 for a given angular movement in this region, the secondary spacing D2 in the plurality of holes 40 (from the second portion 16) is preferably greater than then primary spacing D1 from the plurality of holes 24 (in the first portion 12). In this way, when the user wishes to tighten/loosen the second L-shaped peg 46 by a predetermined number of holes on the first portion 12, the wrist strap ensures that the first L-shaped peg 32 is also tightened/loosened by the same number of holes on the second portion 16, as opposed to being slightly off alignment in the case of the primary spacing D1 being the same as the secondary spacing D2.

As described herein, the aperture 28 and L-shaped pegs 32;46 have been described as being located on the first and second rigid members 30;44. It will be appreciated however, that any of the aperture 28 and/or L-shaped pegs 32;46 could instead be attached to, and/or embedded directly into, the first and second portions 12;16. In this case, either or both of the first and second rigid members may be dispensed with.

A particular application for the wrist strap described herein is in amusement parks, theme parks, and water parks, which incorporate smart-queuing. In such applications, the wrist strap may comprise an electronic device with a user interface, wherein the electronic device is operable to inform the wearer of the wrist strap when to precede to a predetermined ride in the park. In situations where the user then catches the wrist strap whilst on a ride in the park, the two portions of the wrist strap then separate from each other, thus allowing the wrist strap to fall away from the user's wrist.

Noting the above applications, it is apparent that the wrist strap 10 is suited for use by a wide variety of different users, and potentially a different user each time the wrist strap 10 is worn. This suitability stems from the wrist strap being adjustable in use without the need for any deconstruction of the wrist strap, such as via the introduction of spacer/link portions in the wrist strap. Instead, to adjust the length of the wrist strap 10 during use, a user simply disengages each L-shaped peg 32;46 from the hole H2;H1 from the plurality of holes 40;24 in which it is engaged, tightens/loosens the amount of the second portion 16 passed through the aperture 28 as required, and then re-engages each L shaped peg 32;46 in a different hole H2;H1 from the plurality of holes 40;24.

In applications where the separation of the two portions of the wrist strap is not required in the case of the wrist strap being caught on an object, it will be appreciated that the L-shaped pegs 32;46 could instead have any other shape, such as a mushroom-shape as shown in the pegs from WO 2017/037238.

In relation to the first and second pegs 32;46 described herein, it will be appreciated that the wrist strap 10 could work with only one of these pegs 32;46. In this case, only one set of the plurality of holes 24;40 would be required on the wrist strap 10, the set of holes being located on the opposite portion of the wrist strap to the portion of the wrist strap having the peg.

It will also be appreciated that the second portion 16 could instead pass from the outside surface 30B of the first rigid member 30, through the aperture 28, and out past the inside surface 30A of the first rigid member 30. In this way, once passed through the aperture 28, the second portion 16 of the wrist strap would extend around the inside of the first portion 12 of the wrist strap. In this configuration, the arms 34;48 from the first and second L-shaped pegs 32;46 would be configured to face outwards in a direction away from the user's wrist. The secondary spacing D2 in the plurality of holes 40 in this configuration would then preferably be less than, as opposed to greater than, the primary spacing D1 from the plurality of holes 24 in the first portion 12.

The invention claimed is:

1. A wrist strap comprising a first portion defining a first end of the wrist strap, and a second portion defining a second end of the wrist strap, the wrist strap further comprising:

an aperture located in the first portion, through which the second end of the strap is passable to define an overlapping region in which a part of the first portion and the second portion of the wrist strap overlap;

a first L-shaped peg located in one portion of the first and second portions, and a first hole in the strap located in the other portion of the first and second portions;

wherein the first L-shaped peg and the first hole are located in the overlapping region once the second end of the strap is passed through the aperture, such that the first L-shaped peg is engageable with the first hole;

wherein the first L-shaped peg is shaped such that when engaged in the first hole, the end of the first L-shaped peg extends in a direction away from the end of the strap located in the other portion.

2. A wrist strap according to claim 1, further comprising:

a second L-shaped peg located in the other portion of the first and second portions, and a second hole in the strap located in the one portion;

wherein the second L-shaped peg and the second hole are located in the overlapping region once the second end of the strap is passed through the aperture, such that the second L-shaped peg is engageable with the second hole;

wherein the second L-shaped peg is shaped such that when engaged in the second hole, the end of the second L-shaped peg extends in a direction away from the end of the strap located in the one portion.

3. An apparatus comprising a wrist strap according to claim 2, and further comprising an electronic device with a user interface, wherein the electronic device is operable to inform a wearer of the wrist strap when to proceed to a predetermined ride in a park.

4. An apparatus comprising a wrist strap according to claim 1, and further comprising an electronic device with a user interface, wherein the electronic device is operable to inform a wearer of the wrist strap when to proceed to a predetermined ride in a park.

5. A wrist strap comprising a first portion defining a first end of the wrist strap, and a second portion defining a second end of the wrist strap, the wrist strap further comprising:

an aperture located in the first portion, through which the second end of the strap is passable to define an overlapping region in which a part of the first portion and the second portion of the wrist strap overlap;

a first peg located in the first portion, and a first plurality of holes in the second portion;

a second peg located in the second portion, and a second plurality of holes located in the first portion;

wherein once the second end of the strap is passed through the aperture, the first peg and a hole from the first plurality of holes are located in the overlapping region, such that the first peg is engageable with the hole from the first plurality of holes;

wherein once the second end of the strap is passed through the aperture, the second peg and a hole from the second plurality of holes are located in the overlapping region such that the second peg is engageable with the hole from the second plurality of holes;

wherein the spacing between the holes in the first plurality of holes is different than the spacing between the holes in the second plurality of holes.

6. A wrist strap according to claim 5:

wherein the first peg is L-shaped, such that when engaged in a hole from the first plurality of holes, the end of the first L-shaped peg extends in a direction away from the second end of the strap.

7. An apparatus comprising a wrist strap according to claim 6, and further comprising an electronic device with a user interface, wherein the electronic device is operable to inform a wearer of the wrist strap when to proceed to a predetermined ride in a park.

8. A wrist strap according to claim 5:

wherein the second peg is L-shaped, such that when engaged in a hole from the second plurality of holes, the end of the second L-shaped peg extends in a direction away from the first end of the strap.

9. A wrist strap according to claim 6:

wherein the second peg is L-shaped, such that when engaged in a hole from the second plurality of holes, the end of the second L-shaped peg extends in a direction away from the first end of the strap.

10. An apparatus comprising a wrist strap according to claim 9, and further comprising an electronic device with a user interface, wherein the electronic device is operable to inform a wearer of the wrist strap when to proceed to a predetermined ride in a park.

11. An apparatus comprising a wrist strap according to claim 8, and further comprising an electronic device with a user interface, wherein the electronic device is operable to inform a wearer of the wrist strap when to proceed to a predetermined ride in a park.

12. An apparatus comprising a wrist strap according to claim 5, and further comprising an electronic device with a user interface, wherein the electronic device is operable to inform a wearer of the wrist strap when to proceed to a predetermined ride in a park.

* * * * *